US011000967B2

(12) United States Patent
Stopfer et al.

(10) Patent No.: US 11,000,967 B2
(45) Date of Patent: May 11, 2021

(54) METHOD FOR PRODUCING A WOOD VENEER, VENEER BLOCK, METHOD FOR PRODUCING A MOLDED PART, AND MOLDED PART

(71) Applicant: NOVEM Car Interior Design GmbH, Vorbach (DE)

(72) Inventors: Manfred Stopfer, Schlammersdorf (DE); Sebastian Koch, Creussen (DE); Volker Mueller, Kastl (DE)

(73) Assignee: NOVEM CAR INTERIOR DESIGN GMB, Vorbach (DE)

( * ) Notice: Subject to any disclaimer, the term of this patent is extended or adjusted under 35 U.S.C. 154(b) by 43 days.

(21) Appl. No.: 16/013,593

(22) Filed: Jun. 20, 2018

(65) Prior Publication Data

US 2018/0370070 A1 Dec. 27, 2018

(30) Foreign Application Priority Data

Jun. 21, 2017 (DE) ..... 10 2017 113 764.5

(51) Int. Cl.

| | |
|---|---|
| ***B27D 5/00*** | (2006.01) |
| ***B27D 3/00*** | (2006.01) |
| ***B27L 5/00*** | (2006.01) |
| ***B27D 1/00*** | (2006.01) |
| ***B27D 1/08*** | (2006.01) |
| ***B27M 3/18*** | (2006.01) |
| ***B27D 1/04*** | (2006.01) |

(52) U.S. Cl.

CPC ..... *B27D 5/00* (2013.01); *B27D 1/00* (2013.01); *B27D 1/04* (2013.01); *B27D 1/08* (2013.01); *B27D 3/00* (2013.01); *B27L 5/00* (2013.01); *B27M 3/18* (2013.01); *Y10T 156/1062* (2015.01); *Y10T 156/1075* (2015.01)

(58) Field of Classification Search

CPC ... B27M 3/18; B27D 3/00; B27D 3/02; B27D 5/00; B27D 1/04; B27D 1/08; B27L 5/00; Y10T 156/1075; Y10T 156/1062; B32B 2038/042

See application file for complete search history.

(56) References Cited

U.S. PATENT DOCUMENTS 5,161,591 A * 11/1992 Sealey ..... B27L 11/08 144/2.1

* cited by examiner

*Primary Examiner* — Linda L Gray
(74) *Attorney, Agent, or Firm* — Workman Nydegger

(57) ABSTRACT

A method for producing a wood veneer, where the wood veneer is provided as a decorative layer for a trim piece for a vehicle interior, wherein the molded part has at least one line element on a visible side, can involve the steps of a) providing a wood blank, b) generating two-dimensional cutting data by developing a designated three-dimensional shape of the wood veneer c) forming wood slats by cutting out the two-dimensional developed form of the wood veneer from the wood blank and slicing the two-dimensional developed form along the developed line elements on the basis of the two-dimensional cutting data, d) layering and gluing the cut wood slats to form a veneer block, e) compressing the wood slats and curing the veneer block, f) separating the veneer block into wood veneers. Moreover, the invention relates to a veneer block, a molded part, and corresponding methods of production.

16 Claims, 3 Drawing Sheets

METHOD FOR PRODUCING A WOOD VENEER, VENEER BLOCK, METHOD FOR PRODUCING A MOLDED PART, AND MOLDED PART

CROSS-REFERENCE TO RELATED APPLICATIONS

The present invention claims the benefit of priority to German Patent Application No. 10 2017 113 764.5, filed Jun. 21, 2017, entitled "Method for producing a wood veneer, veneer block, method for producing a molded part, and molded part" the entire content of which is incorporated herein by reference.

BACKGROUND OF THE INVENTION

1. The Field of the Invention

This invention relates to a method for producing a wood veneer and a veneer block for producing a wood veneer. Moreover, the invention relates to a method for producing a decorative and/or trim piece for a vehicle interior fashioned as a molded part, and a molded part.

2. Background and Relevant Art

The wood veneer is designed as a decorative layer for a decorative and/or trim piece for a vehicle interior fashioned as a molded part, wherein the molded part has at least one line element on its front side, designed as the visible side.

Molded parts with line elements are known in themselves. The line elements may be so-called "flowing lines" or "form-following lines" as a styling element on the visible side of the molded part, such as line-shaped grooves.

These line elements are milled out in known molded parts, in particular being milled out in the finished structural parts in a costly manner with CNC milling machines, especially 5-axis CNC milling machines. This results in long process times and high production costs.

A further drawback of milling is that the wood structure and the shape of the structural part do not match up. This has the result that wood fibers may stick out along the grooves and stained margins may be formed in the coloration. Due to deviations between wood structure and grooves, weak sites may also be created on the structural part, possibly resulting in breakage. The aforementioned drawbacks result in long processing times and increased rejects.

Furthermore, the minimal diameter of the grooves is dependent on the diameter of the milling cutter. Moreover, the milled grooves may result in light irritation in the case of backlit structural parts.

BRIEF SUMMARY OF THE INVENTION

The problem which the present invention proposes to solve is to indicate a new method for producing a wood veneer as well as a new veneer block for producing a wood veneer, wherein the wood veneer is provided as a decorative layer for a decorative and/or trim piece for a vehicle interior fashioned as a molded part, wherein the molded part has line elements on its front side, designed as the visible side, with which drawbacks of the aforementioned milled grooves are at least for the most part avoided. Moreover, the problem of the invention is to indicate a new method for producing a decorative and/or trim piece for a vehicle interior fashioned as a molded part and a new molded part in which the decorative layer is a wood veneer that has been produced from a veneer block according to the invention or produced with a method according to the invention.

This problem is solved in regard to the features of the claimed method for producing a wood veneer, and features of the claimed veneer block for producing a wood veneer The problem is further solved by the features of the method for producing a decorative and/or trim piece fashioned as a molded part, and by the features of the claimed molded. Advantageous embodiments and modifications are indicated in the respective independent and dependent claims.

The method according to the invention for producing a wood veneer involves the steps:

a) providing a wood blank, b) generating two-dimensional cutting data by developing a designated three-dimensional shape of the wood veneer including line elements provided in the wood veneer into a two-dimensional developed form of the wood veneer with developed line elements, c) forming wood slats by cutting out the two-dimensional developed form of the wood veneer from the wood blank and slicing the two-dimensional developed form along the developed line elements on the basis of the two-dimensional cutting data, d) layering and gluing the cut wood slats to form a veneer block, e) compressing the wood slats and curing the veneer block, f) separating the veneer block into wood veneers.

Steps a) and b) may be provided in any given sequence, in particular, the generating of two-dimensional cutting data as per step b) may occur already distinctly prior to the providing of a wood blank as per step a).

The benefits of the method according to the invention lie especially in the fact that the line elements, such as "form-following lines" or "flowing lines", are introduced already in the veneer block and this veneer block is then worked up into wood veneers. This means that the drawbacks of milled grooves are at least for the most part avoided.

The wood blank may be a massive piece of wood, especially a single piece of massive wood, not being composed of several partial pieces and thus also not having any glue bonding. However, it may also be a glue-bonded block composed of laminate layers or veneer layers or wooden boards.

It is also possible to at first carry out steps a) to e), and then to provide the veneer block cured in step e) as a wood blank in a further step a) and once again to carry out steps b) to e) and only then to carry out step f). It is also possible to perform steps a) to e) several times in each case with the veneer block last cured as per step e) as a wood blank in step a), before step f) is carried out.

Preferably when providing the wood blank a single wood blank is provided for the entire veneer block to be produced and consequently for the wood veneer to be produced.

The line elements may be "form-following lines" or "flowing lines" as a styling element on the visible side of the molded part. Preferably, it is provided that the line elements run at least partly in a curve. For example, line elements may at least substantially follow an outer shape of the molded part. However, the line elements may also run entirely as straight lines.

Moreover, it is preferably provided that the line elements run parallel to the front side of the molded part. In particular, the line elements extend between two opposite edges of the wood veneer.

When speaking above or in the following of line elements, this means both a plurality of line elements, i.e., two or three or four or five line elements, etc., and also only a single line element. The use of the plural form "line elements" was chosen merely for reasons of better comprehension of the text. When a plurality of line elements are provided, these may run at least substantially parallel to each other, but also differing forms are possible.

The generating of the two-dimensional cutting data as per step b) may be done for example by calculating the two-dimensional development from three-dimensional CAD data. The cutting out and slicing on the basis of the two-dimensional cutting data as per step c) may be done by generating from the two-dimensional cutting data NC codes (NC is the abbreviation for Numerical Control) for a CNC cutting machine (CNC is the abbreviation for Computerized Numerical Control).

The cutting out of the developed two-dimensional form of the wood veneer from the wood blank as per step c) is advisedly done by cutting along the edges (margins) of the developed two-dimensional form.

An especially preferred modification of the invention proposes that the two-dimensional developed form of the wood veneer and the developed line elements are cut out from the wood blank such that the two-dimensional developed form of the wood veneer and/or the developed line elements follow a principal direction of a wood structure in the wood blank.

"Follow the principal direction of a wood structure" can mean that the two-dimensional developed form of the wood veneer and/or the developed line elements coincide at least in part with at least one section of a structure dictated by the grain of the wood or run at least substantially parallel to this structure or are at least similar to it.

If expedient, the two-dimensional developed form of the wood veneer and the developed line elements may also be marked out on or at the wood blank prior to the cutting, for example, to control the orientation of the form and/or line elements in relation to a principal direction of a wood structure in the wood blank.

Preferably, during the cutting out and slicing as per step c), the cutting is done along an outer contour of the developed form of the wood veneer and along the developed line elements, the sequence of the cuts usually not being important, that is, the cutting sequence may be optimized in terms of the cutting installation used.

Preferably, the cutting and slicing are done by means of high-pressure water jet cutting. Advisedly in this case a protective film is glued onto the side of the wood blank where the water jet impinges. Alternatively, the cutting and slicing may also be done by means of laser beam cutting or chip removing methods, such as CNC milling or band sawing, or punching.

An especially preferred variant embodiment of the invention proposes that during the layering and gluing of the cut wood slats the wood slats are layered in the same arrangement with respect to each other as they were arranged in the wood blank with respect to each other.

In step d), also only some of the cut wood slats may be layered and glued in order to form the veneer block. To form the veneer block it is also possible to provide in addition to the wood slats cut in the preceding step of the method further woods slats, which have been cut out from one or more other wood blanks, especially from wood blanks of a different kind of wood. In this way, wood slats of different woods can be blended to form the veneer block.

Between two wood slats there can be provided only one glue layer, by which the wood slats are glued together. This glue layer then forms a line element in the finished wood veneer.

Alternatively, according to one modification of the invention, during the layering and gluing of the cut wood slats at least one intermediate layer is inserted between every two wood slats. This intermediate layer then forms a line element in the finished wood veneer. Preferably, the intermediate layer is glued between the two wood slats.

The intermediate layer may be transparent and/or translucent.

The intermediate layer may be a lightguide or a light fabric.

According to one variant embodiment of the invention, the intermediate layer is or comprises a contrast veneer and/or a metal layer, especially an aluminum sheet and/or a copper sheet and/or a brass sheet, and/or a metal weave and/or metal strands and/or metal wires and/or a film, especially a plastic film, preferably a polycarbonate film, and/or textiles and/or leather and/or fleece and/or paper and/or cardboard and/or mineral materials (such as the mineral material known under the brand Corean®) and/or natural rubber and/or rubbers such as ethylene-propylene-diene rubbers (EPDM).

It may be provided that the gluing of the wood slats makes use of an adhesive which is or comprises polyurethane (PUR) and/or epoxy resin (EP). PVAC (polyvinylacetate) glues or resins such as urea resins or melamine resins or phenolic resins or acrylates may also be considered as the adhesive.

The adhesive may be applied to one or both of the surfaces being joined together. In the event that at least one intermediate layer is provided between two wood slats, adhesive may be applied to both of the surfaces of the wood slats to be joined together and enclose the intermediate layer between them. Likewise, adhesive may be applied to one or both of the surfaces of the intermediate layer to be glued.

According to another variant embodiment of the invention, during the compressing of the wood slats at least one cutting residue of the wood blank produced during the cutting and slicing as per step c) is used at least partly as a die and/or punch and/or support for the wood slats. Preferably, two cutting residues produced on opposite outer wood slats are used as dies and punches for the compressing of the wood slats.

In particular, it may be provided here that cutting residues produced during the cutting and slicing as per step c) are used at least partly as a die and/or punch and/or support for the wood slats during the compressing of the wood slats, wherein the wood slats are arranged between the cutting residues in the way in which the cutting residues and the wood slats were arranged in the original wood blank. The wood slats may then be glued together by compression between the cutting residues. This affords the advantage that no separate punch and die is required, so that even small lot numbers can be produced economically.

Of course, it is also alternatively possible to use a specially made die and/or punch and/or support.

It may be provided that the veneer block is sliced for separating into wood veneers, preferably with a vertical and/or horizontal and/or longitudinal razor machine. Alternatively, it may be provided that the veneer block is sawed for separating into wood veneers, preferably with a band saw, such as a horizontal band saw.

According to one development of the invention, the separating of the veneer block is done with an angle between 0° and 180° to cut surfaces of the wood slats, especially with an angle between 45° and 135° to cut surfaces of the wood slats. Preferably, the separating of the veneer block is done perpendicular to the cutting of the wood slats.

The veneer block according to the invention is intended for producing a wood veneer, which is provided as a decorative layer for a decorative and/or trim piece for a vehicle interior fashioned as a molded part. This molded part has at least one line element on its front side, designed as the visible side. The veneer block according to the invention comprises wood slats cut from a single wood blank. Preferably, the wood slats are layered in the same arrangement with respect to each other in the veneer block as they were arranged with respect to each other in the wood blank.

As regards the line elements, the foregoing remarks apply to the explanation of the method according to the invention for producing a wood veneer. In particular, only one glue layer between two wood slats may form a line element in the finished wood veneer, which may also be transparent or translucent or colored, for example.

Preferably the wood slats are glued together, wherein the adhesive is or comprises polyurethane (PUR) and/or epoxy resin (EP). PVAC (polyvinylacetate) glues or resins such as urea resins or melamine resins or phenolic resins or acrylates may also be considered as the adhesive.

According to one modification of the invention, it is provided that the veneer block has at least one intermediate layer between at least two wood slats. This intermediate layer then forms in the finished wood veneer a line element. Optionally, the intermediate layer may also be only a glue layer.

Preferably, the intermediate layer is glued between the two wood slats.

Preferably, the intermediate layer is transparent and/or translucent.

The intermediate layer may also be a contrast veneer and/or a metal layer, especially an aluminum sheet and/or a copper sheet and/or a brass sheet, and/or a metal weave and/or metal strands and/or metal wires and/or a film, especially a plastic film, preferably a polycarbonate film, and/or a textile and/or leather and/or fleece and/or paper and/or cardboard and/or mineral materials (such as the mineral material known under the brand Corean®) and/or natural rubber and/or rubbers such as ethylene-propylene-diene rubbers (EPDM).

The method according to the invention for producing a decorative and/or trim piece for a vehicle interior fashioned as a molded part, wherein the molded part comprises a decorative layer and has at least one line element on its front side, designed as the visible side, is characterized in that the decorative layer is a wood veneer produced from a veneer block according to the invention, and preferably with a method according to the invention.

The molded part according to the invention, which is a decorative and/or trim piece for a vehicle interior fashioned as a molded part, comprises a decorative layer and has at least one line element on its front side, designed as the visible side. The molded part is characterized in that the decorative layer is a wood veneer produced from a veneer block according to the invention, and preferably produced with a method according to the invention.

BRIEF DESCRIPTION OF THE DRAWINGS

The invention shall be explained more closely below, also with regard to further features and advantages, with the aid of the description of sample embodiments and making reference to the enclosed schematic drawings, in which.

DETAILED DESCRIPTION OF THE PREFERRED EMBODIMENTS

Figure 1:
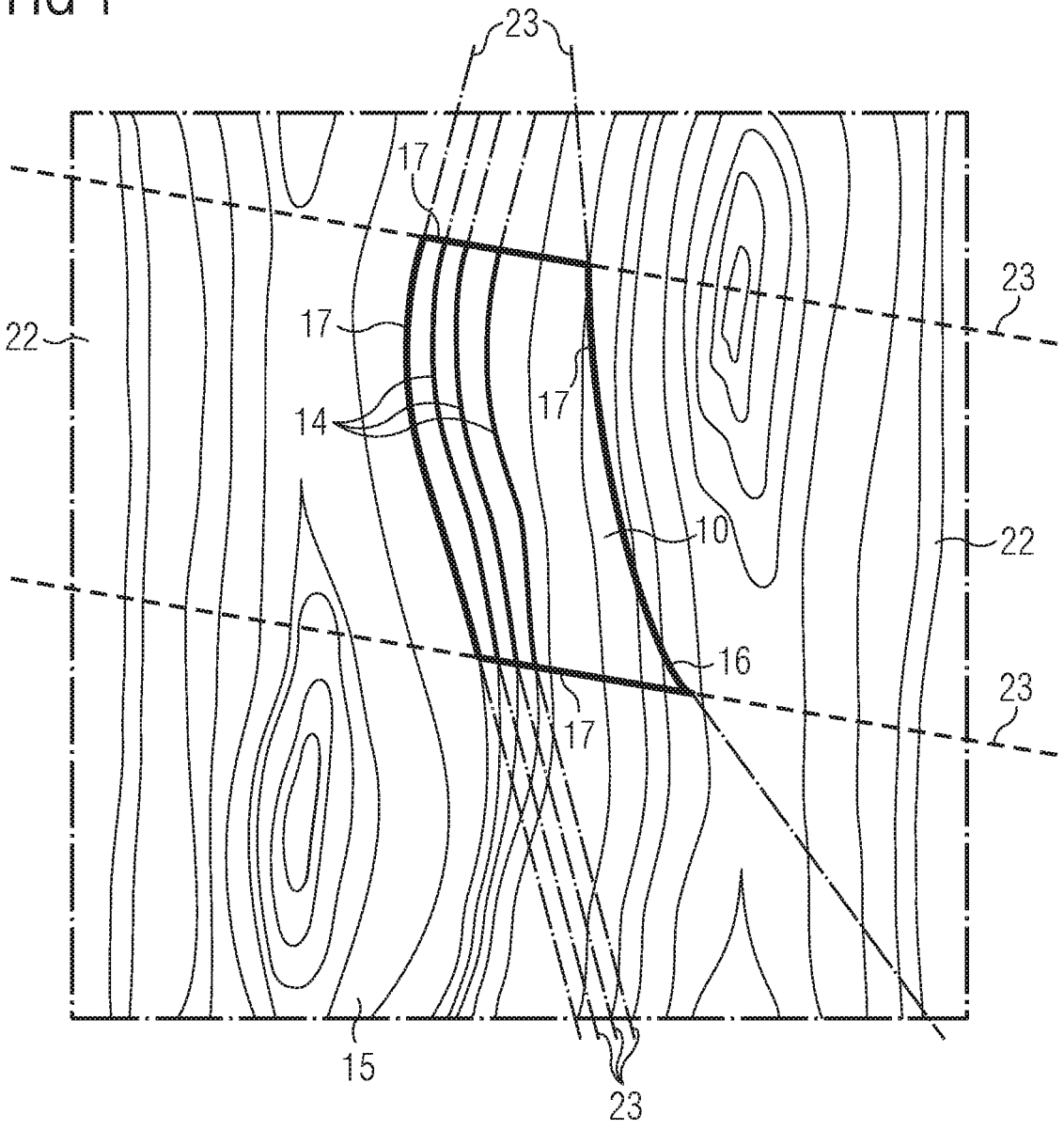
FIG. 1 shows a schematic representation of a sample embodiment of a wood blank with an indicated two-dimensional developed form of an intended wood veneer and developed line elements.

Corresponding parts and components are designated with the same references in the figures, even among the different sample embodiments. Moreover, it should be noted that the dimensional relations, especially the layer thicknesses, are purely schematic to illustrate the invention and need not conform to the actual dimensional relations.

With the aid of the following drawings, a sample embodiment of the method according to the invention shall be explained more closely.

The method according to the invention is intended for producing a wood veneer 10. The wood veneer 10 is intended as a decorative layer 11 for a decorative and/or trim piece for a vehicle interior fashioned as a molded part 12. The molded part 12 should have line elements 14 on its front side 13 designed as the visible side.

In a step a) of the method according to the invention, a wood blank 15 is provided as represented in FIG. 1. A single wood blank 15 is provided for the entire veneer block 19 to be produced and consequently for the wood veneer 10 to be produced.

In a step b) of the method according to the invention, which may be performed after, but also before step a), two-dimensional cutting data is generated by developing an intended three-dimensional form of the wood veneer 10 including line elements 14 provided in the wood veneer 10 into a two-dimensional developed form 16 of the wood veneer 10 with developed line elements 14. In FIG. 1, the two-dimensional developed form 16 of the wood veneer 10 and the developed line elements 14 are marked out on the wood blank 15 for clarity.

The two-dimensional developed form 16 of the intended wood veneer 10 and the developed line elements 14 are oriented in relation to the wood blank 15 such that the two-dimensional developed form 16 of the intended wood veneer 10 and the developed line elements 14 follow a principal direction of a wood structure of the wood blank 15. "Follow the principal direction of a wood structure" means in this case that the two-dimensional developed form 16 of the intended wood veneer 10 and the developed line elements 14 at least partly coincide with at least one section of the wood structure dictated by the grain of the wood or match up with this wood structure.

Next, in a step c) of the method according to the invention, the two-dimensional developed form 16 is cut out from the wood blank 15 along the edges 17 of the two-dimensional developed form 16. Moreover, cutting is done along the developed line elements 14. In this way, wood slats 18 are formed.

During the cutting and slicing as per step c), cutting is done along several cutting edges 23 which may also extend beyond the actual edges 17 of the two-dimensional developed form 16, depending on the cutting method used. For example, the cutting and slicing may be done by means of high-pressure water jet cutting. In this case, the cutting edges 23 shown in FIG. 1 and extending beyond the two-dimensional developed form 16 may optionally be omitted.

Figure 2:
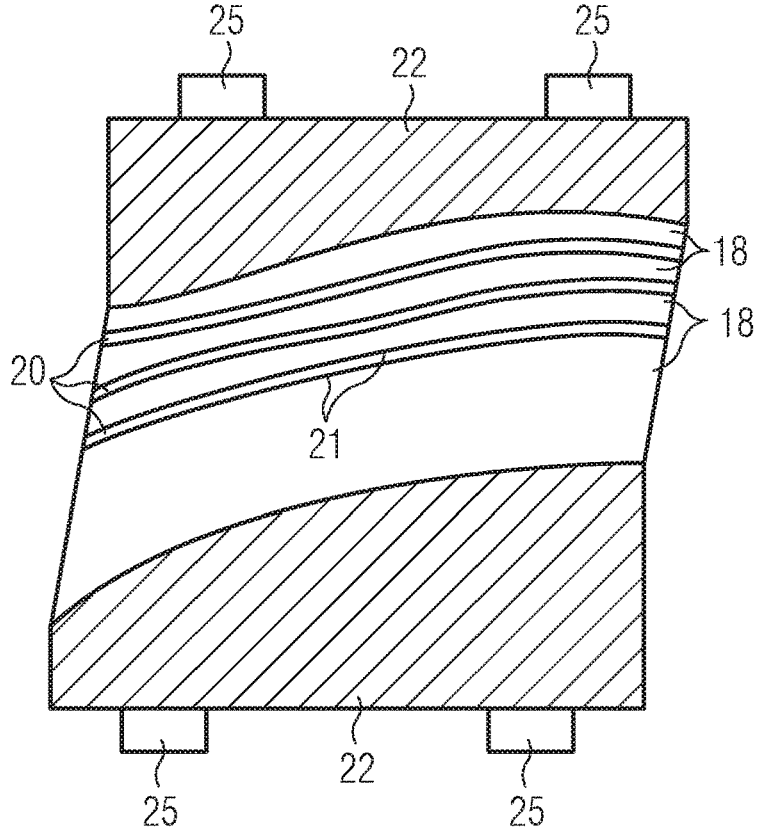
FIG. 2 shows a schematic representation of a sample embodiment of a veneer block to be produced according to the invention.

The cut wood slats 18 are then layered and glued together in a step d) of the method according to the invention to form a veneer block 19, as shown in FIG. 2.

During the layering and gluing together of the cut wood slats 18, the wood slats 18 are layered in the same arrangement with respect to each other as they were arranged with respect to each other in the wood blank 15.

Furthermore, during the layering and gluing together of the cut wood slats 18 an intermediate layer 20 is inserted between every two wood slats 18. The intermediate layer may be a contrast veneer and/or a metal layer, especially an aluminum sheet and/or a copper sheet and/or a brass sheet, and/or a film, especially a polycarbonate film, and/or a textile and/or leather and/or fleece.

For the gluing together of the wood slats 18 an adhesive 21 is used which comprises PUR and/or epoxy resin, the adhesive 21 being applied to both surfaces of the wood slats 18 to be glued together.

After this, in a step e) of the method according to the invention, the wood slats 18 are compressed and the resulting veneer block 19 is cured.

During the compression of the wood slats 18, as shown in FIG. 2, two cutting residues 22 of the wood blank produced during the cutting and slicing as per step c) are used as die and/or punch and/or support for the wood slats 18. These may be clamped for example in a vise 25.

Figure 3:
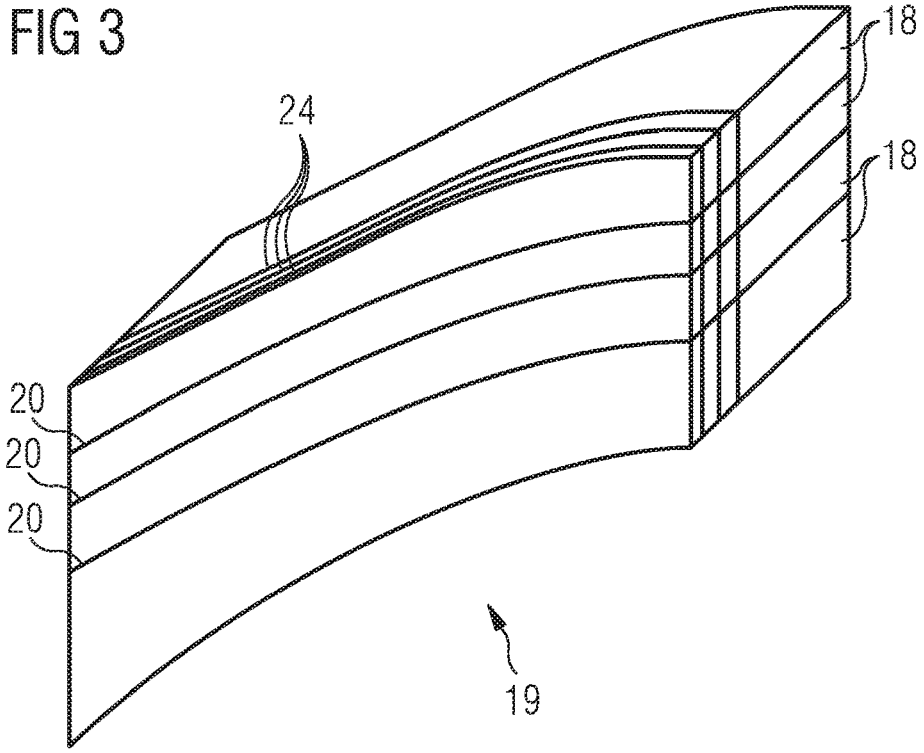
FIG. 3 shows a schematic representation of a sample embodiment of a veneer block according to the invention.

In a final step f) of the method, the veneer block 19 as shown in FIG. 3 is separated into wood veneers 10, the veneer block 19 being sliced for the separation into wood veneers 10, preferably with a vertical and/or horizontal and/or longitudinal razor machine. One example of a wood veneer 10 formed in such a way is shown in FIG. 4.

For the slicing, the slicing is done along the parting edges 24 on the veneer block 19 as shown in FIG. 3. The separating of the veneer block 19 occurs along the parting edges 24 and thus preferably perpendicular to the former cutting edges 23 of the wood slats 18.

Figure 5:
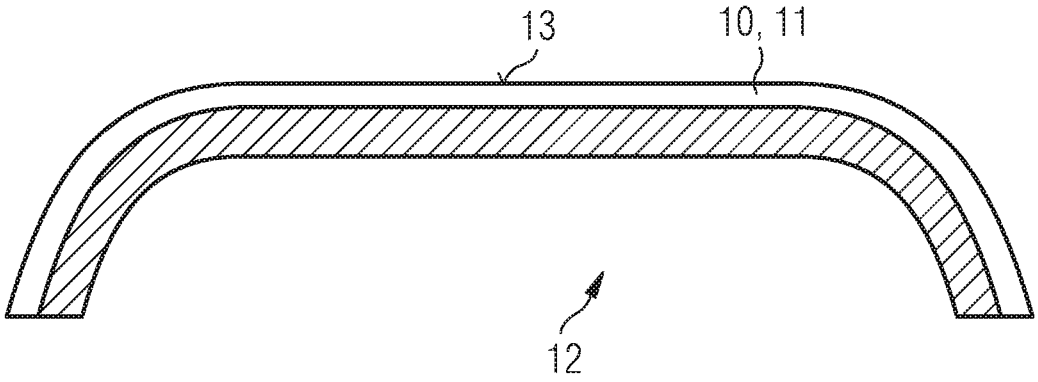
FIG. 5 shows a schematic representation of a sample embodiment of a molded part according to the invention.

FIG. 5 shows a molded part 12 according to the invention. The molded part 12 is a decorative and/or trim piece for a vehicle interior fashioned as a molded part 12. It comprises a decorative layer 11 and has line elements 14 (not shown) on its front side 13, designed as the visible side, which extend parallel to this front side 13.

Figure 4:
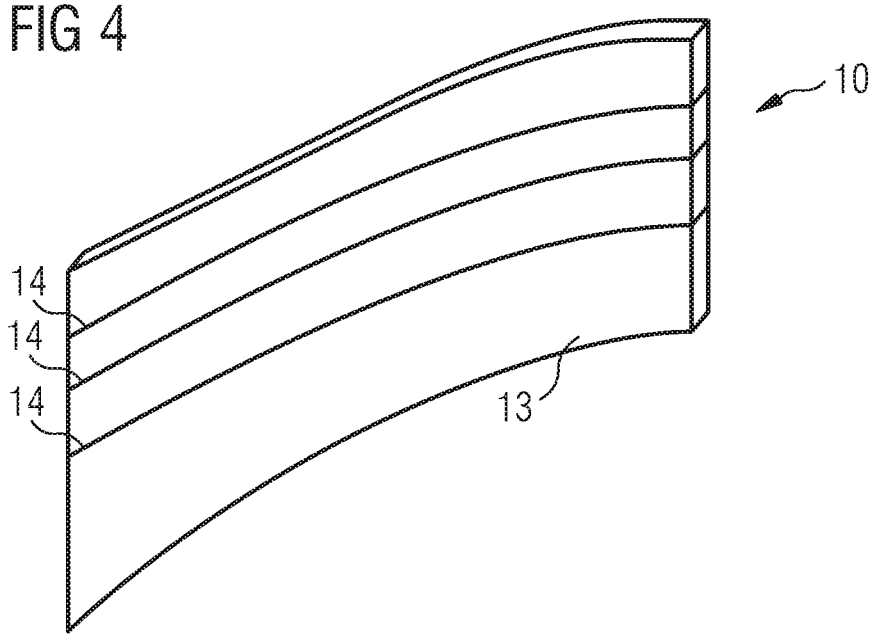
FIG. 4 shows a schematic representation of a sample embodiment of a wood veneer.

The decorative layer 11 is a wood veneer 10, as shown in FIG. 4, which was produced from a veneer block 19, shown in FIG. 3. The veneer block 19 comes from a single wood blank 15, shown in FIG. 1.

The wood veneer may, as shown in FIG. 5, be back-injected with a carrier and thereby be pressed into a form intended for the molded part 12.

LIST OF REFERENCE NUMBERS

10 Wood veneer
11 Decorative layer
12 Molded part
13 Front side
14 Line elements
15 Wood blank
16 Form
17 Edge
18 Wood slat
19 Veneer block
20 Intermediate layer
21 Adhesive
22 Cutting residue
23 Cutting edge
24 Parting edge
25 Vise

We claim:

1. A method for producing a wood veneer, wherein the wood veneer is provided as a decorative layer for a decorative and/or trim piece for a vehicle interior fashioned as a molded part, wherein the molded part has at least one line element on its front side, designed as a visible side, comprising the steps of:

a) providing a wood blank;

b) generating two-dimensional cutting data by developing a designated three-dimensional shape of the wood veneer including line elements provided in the wood veneer into a two-dimensional developed form of the wood veneer with developed line elements;

c) forming wood slats by cutting out the two-dimensional developed form of the wood veneer from the wood blank, and slicing in sequence the two-dimensional developed form along the developed line elements on the basis of the two-dimensional cutting data;

d) layering and gluing with an adhesive the cut wood slats;

e) compressing the layered and glued wood slats, and curing the adhesive to form a veneer block; and f) separating the veneer block into wood veneers.

2. The method as claimed in claim 1, wherein, upon completion of steps a) to e), step f) is carried out upon completion of the following:

providing the veneer block cured in step e) as a wood blank in a further step a); and repeating steps b) to e).

3. The method as claimed in claim 1, wherein:

the two-dimensional developed form of the wood veneer and the developed line elements are cut out from the wood blank, such that the two-dimensional developed form of the wood veneer and/or the developed line elements follow a principal direction of a corresponding wood structure in the wood blank.

4. The method as claimed in claim 1, wherein:

the cutting and slicing of step c) are done with: a) a high-pressure water jet cutting, b) laser beam cutting, or c) chip removing methods comprising CNC milling, band sawing, or punching.

5. The method as claimed in claim 1, wherein:

during the layering and gluing of the cut wood slats, the wood slats are layered in the same sequence in which they were sliced from the wood blank.

6. The method as claimed in claim 1, wherein:

during the layering and gluing of the cut wood slats at least one intermediate layer is inserted between every two wood slats.

7. The method as claimed in claim 1, wherein:

the adhesive comprises polyurethane and/or epoxy resin and/or PVAC glue and/or urea resin and/or melamine resin and/or phenolic resin and/or acrylate.

8. The method in claim 1, wherein:

during the compressing of the wood slats at least one cutting residue of the wood blank produced during the cutting and slicing as per step c) is used as a die and/or punch and/or support for the wood slats.

9. The method as claimed in claim 1, wherein:

the veneer block is sliced for separating into wood veneers, or the veneer block is sawed for separating into wood veneers.

10. The method as claimed in claim 1, wherein:

the separating of the veneer block is done with an angle between 0° and 180° to cut surfaces of the wood slats.

11. A method for producing a decorative and/or trim piece for a vehicle interior fashioned as a molded part comprising a wood veneer, wherein the molded part comprises a decorative layer and has at least one line element on its front side, designed as a visible side, wherein the wood veneer is provided as a decorative layer for decorative and/or trim piece for a vehicle interior fashioned as a molded part, wherein: the molded part has at least one line element on its front side, designed as the visible side, and a veneer block comprises wood slats cut from a wood blank, the method comprising:

a) providing the wood blank;

b) generating two-dimensional cutting data by developing a designated three dimensional shape of the wood veneer including line elements provided in the wood veneer into a two-dimensional developed form of the wood veneer with developed line elements;

c) forming wood slats by cutting out the two-dimensional developed form of the wood veneer from the wood blank, and slicing in sequence the two-dimensional developed form along the developed line elements on the basis of the two-dimensional cutting data;

d) layering and gluing the cut wood slats with an adhesive to form a veneer block;

e) compressing the wood slats and curing the adhesive to form the veneer block; and f) separating the veneer block into wood veneers.

12. The method as claimed in claim 10, wherein:

the separating of the veneer block is done with an angle between 45° and 135° to cut surfaces of the wood slats.

13. The method as claimed in claim 10, wherein:

the separating of the veneer block is done by cutting surfaces of the wood slats at a perpendicular angle.

14. The method as claimed in claim 11, wherein:

the wood slats are layered in the same sequence with respect to each other in the veneer block as that sequence in which they were sliced from the original wood blank.

15. The veneer block as claimed in claim 14, wherein:

the wood slats are glued together; and the adhesive comprises at least one of: polyurethane, epoxy resin, PVAC glue, urea resin, melamine resin, phenolic resin, acrylate.

16. The veneer block as claimed in claim 14, wherein the wood veneer has at least one intermediate layer between at least two wood slats.

* * * * *